US010818302B2

(12) United States Patent
Wang et al.

(10) Patent No.: US 10,818,302 B2
(45) **Date of Patent: *Oct. 27, 2020**

(54) AUDIO SOURCE SEPARATION

(71) Applicant: Dolby Laboratories Licensing Corporation, San Francisco, CA (US)

(72) Inventors: Jun Wang, Beijing (CN); Lie Lu, Dublin, CA (US); Qingyuan Bin, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/561,836

(22) Filed: Sep. 5, 2019

(65) Prior Publication Data

US 2019/0392848 A1 Dec. 26, 2019

Related U.S. Application Data

(63) Continuation of application No. 16/091,069, filed as application No. PCT/US2017/026296 on Apr. 6, 2017, now Pat. No. 10,410,641.

(Continued)

(30) Foreign Application Priority Data

May 20, 2016 (EP) ..... 16170722

(51) Int. Cl.
*G10L 19/008* (2013.01)
*G10L 21/0232* (2013.01)

(Continued)

(52) U.S. Cl.
CPC ..... *G10L 19/008* (2013.01); *G10L 21/0232* (2013.01); *G10L 21/0272* (2013.01);

(Continued)

(58) Field of Classification Search
CPC ..... G10L 19/008; G10L 21/0232; G10L 21/0272; G10L 25/18; H04S 7/30; H04S 2400/01

See application file for complete search history.

(56) References Cited

U.S. PATENT DOCUMENTS 7,088,831 B2 8/2006 Rosca
7,650,279 B2 1/2010 Hiekata (Continued)

FOREIGN PATENT DOCUMENTS

GB 2510631 8/2014
JP 2005227512 8/2005

(Continued)

OTHER PUBLICATIONS

Barfuss, H. et al. "An adaptive microphone array topology for target signal extraction with humanoid robots", Sep. 8-11, 2014, Acoustic Signal Enhancement (IWAENC), 2014 14th International Workshop.

(Continued)

*Primary Examiner* — Andrew L Sniezek

(57) ABSTRACT

The present document describes a method for extracting J audio sources from I audio channels. The method includes updating a Wiener filter matrix based on a mixing matrix from a source matrix and based on a power matrix of the J audio sources. Furthermore, the method includes updating a cross-covariance matrix of the I audio channels and of the J audio sources and an auto-covariance matrix of the J audio sources, based on the updated Wiener filter matrix and based on an auto-covariance matrix of the I audio channels. In addition, the method includes updating the mixing matrix and the power matrix based on the updated cross-covariance (Continued)

matrix of the I audio channels and of the J audio sources, and/or based on the updated auto-covariance matrix of the J audio sources.

12 Claims, 3 Drawing Sheets

Related U.S. Application Data

(60) Provisional application No. 62/330,658, filed on May 2, 2016.

(51) Int. Cl.

| | |
|---|---|
| ***G10L 25/21*** | (2013.01) |
| ***H04S 7/00*** | (2006.01) |
| ***G10L 21/0272*** | (2013.01) |
| *G10L 25/18* | (2013.01) |

(52) U.S. Cl.
CPC ..... *G10L 25/21* (2013.01); *H04S 7/30* (2013.01); *G10L 25/18* (2013.01); *H04S 2400/01* (2013.01)

(56) References Cited

U.S. PATENT DOCUMENTS

| | | | | |
|---|---|---|---|---|
| 8,358,563 | B2 | 1/2013 | Hiroe | |
| 8,521,477 | B2 | 8/2013 | Nam | |
| 8,743,658 | B2 | 6/2014 | Claussen | |
| 8,818,001 | B2 | 8/2014 | Hiroe | |
| 9,042,583 | B2 | 5/2015 | Buyens | |
| 10,410,641 | B2 * | 9/2019 | Wang | G10L 25/21 |
| 2007/0025556 | A1 | 2/2007 | Hiekata | |
| 2008/0208538 | A1 | 8/2008 | Visser | |
| 2009/0306973 | A1 | 12/2009 | Hiekata | |
| 2011/0026736 | A1 | 2/2011 | Lee | |
| 2012/0287303 | A1 | 11/2012 | Umeda | |
| 2012/0294446 | A1 | 11/2012 | Visser | |
| 2013/0121506 | A1 | 5/2013 | Mysore | |
| 2014/0058736 | A1 | 2/2014 | Taniguchi | |
| 2014/0288926 | A1 | 9/2014 | Parikh | |
| 2015/0215721 | A1 * | 7/2015 | Sato | H04S 7/30 381/307 |
| 2017/0365273 | A1 | 12/2017 | Wang | |
| 2018/0240470 | A1 | 8/2018 | Wang | |

FOREIGN PATENT DOCUMENTS

| | | |
|---|---|---|
| KR | 1020150016745 | 2/2015 |
| WO | 2015173192 | 11/2015 |

OTHER PUBLICATIONS

Duong, N. "Under-Determined Reverberant Audio Source Separation Using a Full-Rank Spatial Covariance Model", IEEE Transactions on Audio, Speech, and Language Processing, 2010, vol. 18, Issue 7, pp. 1830-1840.

Hiekata, T. et al. "Multiple ICA-based real-time blind source extraction applied to handy size microphone", IEEE International Conference on Acoustics, Speech and Signal Processing, Apr. 19-24, 2009 pp. 121-124.

Hsieh, H. et al. "Online Bayesian learning for dynamic source separation", IEEE International Conference on Acoustics, Speech and Signal Processing, Mar. 14-19, 2010, pp. 1950-1953.

Ikram, M. "Promoting convergence in multi-channel blind signal separation using PNLMS" May 22-27, 2011, Acoustics, Speech and Signal Processing (ICASSP), 2011 IEEE International Conference.

Inoue, S. et al. "3-Dimensional real-time BSS-microphone with spatio-temporal gradient analysis", Aug. 18-21, 2010, SICE Annual Conference 2010, Proceedings, pp. 3439-3444.

Kang, C. et al. "A kind of method for direction of arrival estimation based on blind sourceseparation demixing matrix", 2012 8th International Conference on Natural Computation, May 29-31, 2012 IEEE Conferences, pp. 134-137.

Katayama, T. et al. "A real-time blind source separation for speech signals based on theorthogonalization of the joint distribution of the observed signals", Dec. 20-22, 2011, System Integration (S11), 2011 IEEE/SICE International Symposium.

Lefevre, A. et al "Online Algorithms for Nonnegative Matrix Factorization with the Itakura-Saito Divergence" IEEE Workshop on Applications of Signal Processing to Audio and Acoustics, 2011, pp. 313-316.

Loesch, B. et al. "Online blind source separation based on time-frequency sparseness", Apr. 19-24, 2009, IEEE International Conference on Acoustics, Speech and Signal Processing, pp. 117-120.

Naqvi, S.M. et al. "Multimodal blind source separation for moving sources", Apr. 19-24, 2009, Acoustics, Speech and Signal Processing, 2009. ICASSP 2009. IEEE International.

Ozerov, A. et al. "A General Flexible Framework for the Handling of Prior Information in Audio Source Separation", IEEE Transactions on Audio, Speech, and Language Processing, 2012, vol. 20, Issue: 4, pp. 1118-1133.

Ozerov, A. et al. "Multichannel nonnegative matrix factorization in convolutive mixtures with application to blind audio source separation", Apr. 19, 2009, ICASSP 2009, IEEE Piscataway, NJ, USA, pp. 3137-3140.

Parra, L. et al "Convolutive Blind Separation of Non-Stationary Sources" IEEE Trans on Speech and Audio Processing, vol. 8, No. 3, May 2000, pp. 320-327.

Stanojevic, Tomislav "3-D Sound in Future HDTV Projection Systems," 132nd SMPTE Technical Conference, Jacob K. Javits Convention Center, New York City, New York, Oct. 13-17, 1990, 20 pages.

Stanojevic, Tomislav "Surround Sound for a New Generation of Theaters," Sound and Video Contractor, Dec. 20, 1995, 7 pages.

Stanojevic, Tomislav "Virtual Sound Sources in the Total Surround Sound System," SMPTE Conf. Proc.,1995, pp. 405-421.

Stanojevic, Tomislav et al. "Designing of TSS Halls," 13th International Congress on Acoustics, Yugoslavia, 1989, pp. 326-331.

Stanojevic, Tomislav et al. "Some Technical Possibilities of Using the Total Surround Sound Concept in the Motion Picture Technology," 133rd SMPTE Technical Conference and Equipment Exhibit, Los Angeles Convention Center, Los Angeles, California, Oct. 26-29, 1991, 3 pages.

Stanojevic, Tomislav et al. "The Total Surround Sound (TSS) Processor," SMPTE Journal, Nov. 1994, pp. 734-740.

Stanojevic, Tomislav et al. "The Total Surround Sound System (TSS System)", 86th AES Convention, Hamburg, Germany, Mar. 7-10, 1989, 21 pages.

Stanojevic, Tomislav et al. "TSS Processor" 135th SMPTE Technical Conference, Los Angeles Convention Center, Los Angeles, California, Society of Motion Picture and Television Engineers, Oct. 29-Nov. 2, 1993, 22 pages.

Stanojevic, Tomislav et al. "TSS System and Live Performance Sound" 88th AES Convention, Montreux, Switzerland, Mar. 13-16, 1990, 27 pages.

Tengtrairat, N. et al. "Online Noisy Single-Channel Source Separation Using Adaptive Spectrum Amplitude Estimator and Masking", Sep. 7, 2015, IEEE Transactions on Signal Processing (vol. 64, Issue 7) pp. 1881-1895.

* cited by examiner

AUDIO SOURCE SEPARATION

CROSS-REFERENCE TO RELATED APPLICATIONS

This application is continuation of U.S. patent application Ser. No. 16/091,069, filed Oct. 3, 2018, which is the US National Stage of International Application No. PCT/US2017/026296, filed Apr. 6, 2017, which claims priority to U.S. Provisional Application No. 62/330,658, filed May 2, 2016, European Patent Application No. 16170722.9, filed May 20, 2016 and International Application No. PCT/CN2016/078819, filed Apr. 8, 2016, each of which is incorporated by reference in its entirety.

TECHNICAL FIELD

The present document relates to the separation of one or more audio sources from a multi-channel audio signal.

BACKGROUND

A mixture of audio signals, notably a multi-channel audio signal such as a stereo, 5.1 or 7.1 audio signal, is typically created by mixing different audio sources in a studio, or generated by recording acoustic signals simultaneously in a real environment. The different audio channels of a multi-channel audio signal may be described as different sums of a plurality of audio sources. The task of source separation is to identify the mixing parameters which lead to the different audio channels and possibly to invert the mixing parameters to obtain estimates of the underlying audio sources.

When no prior information on the audio sources that are involved in a multi-channel audio signal is available, the process of source separation may be referred to as blind source separation (BSS). In the case of spatial audio captures, BSS includes the steps of decomposing a multi-channel audio signal into different source signals and of providing information on the mixing parameters, on the spatial position and/or on the acoustic channel response between the originating location of the audio sources and the one or more receiving microphones.

The problem of blind source separation and/or of informed source separation is relevant in various different application areas, such as speech enhancement with multiple microphones, crosstalk removal in multi-channel communications, multi-path channel identification and equalization, direction of arrival (DOA) estimation in sensor arrays, improvement over beam-forming microphones for audio and passive sonar, movie audio up-mixing and re-authoring, music re-authoring, transcription and/or object-based coding.

Real-time online processing is typically important for many of the above-mentioned applications, such as those for communications and those for re-authoring, etc. Hence, there is a need in the art for a solution for separating audio sources in real-time, which raises requirements with regards to a low system delay and a low analysis delay for the source separation system. Low system delay requires that the system supports a sequential real-time processing (clip-in/clip-out) without requiring substantial look-ahead data. Low analysis delay requires that the complexity of the algorithm is sufficiently low to allow for real-time processing given practical computation resources.

The present document addresses the technical problem of providing a real-time method for source separation. It should be noted that the method described in the present document is applicable to blind source separation, as well as for semi-supervised or supervised source separation, for which information about the sources and/or about the noise is available.

SUMMARY

According to an aspect, a method for extracting J audio sources from I audio channels, with I, J>1, is described. The audio channels may for example be captured by microphones or may correspond to the channels of a multi-channel audio signal. The audio channels include a plurality of clips, each clip including N frames, with N>1. In other words, the audio channels may be subdivided into clips, wherein each clip includes a plurality of frames. A frame of the audio channel typically corresponds to an excerpt of an audio signal (for example, to a 20 ms excerpt) and typically includes a sequence of samples.

The I audio channels are representable as a channel matrix in a frequency domain, and the J audio sources are representable as a source matrix in the frequency domain. In particular, the audio channels may be transformed from the time domain into the frequency domain using a time domain to frequency domain transform, such as a short term Fourier transform.

The method includes, for a frame n of a current clip, for at least one frequency bin f, and for a current iteration, updating a Wiener filter matrix based on a mixing matrix, which is adapted to provide an estimate of the channel matrix from the source matrix, and based on a power matrix of the J audio sources, which is indicative of a spectral power of the J audio sources. In particular, the method may be directed at determining a Wiener filter matrix for all the frames n of a current clip and for all the frequency bins f or for all frequency bands $\bar{f}$ of the frequency domain. For each frame n and for each frequency bin f or frequency band $\bar{f}$, meaning for each time-frequency tile, the Wiener filter matrix may be determined using an iterative process with a plurality of iterations, thereby iteratively refining the precision of the Wiener filter matrix.

The Wiener filter matrix is adapted to provide an estimate of the source matrix from the channel matrix. In particular, an estimate of the source matrix $S_{\hat{f}n}$ for the frame n of the current clip and for a frequency bin f may be determined as $S_{\hat{f}n}=\Omega_{\hat{f}n}X_{\hat{f}n}$, wherein $\Omega_{\hat{f}n}$ is the Wiener filter matrix for the frame n of the current clip and for the frequency bin f and wherein $X_{\hat{f}n}$ is the channel matrix for the frame n of the current clip and for the frequency bin f. Hence, subsequently to the iterative process for determining the Wiener filter matrix for a frame n and for a frequency bin f, the source matrix may be estimated using the Wiener filter matrix. Furthermore, using an inverse transform, the source matrix may be transformed from the frequency domain to the time domain to provide the J source signals, notably to provide a frame of the J source signals.

Furthermore, the method includes, as part of the iterative process, updating a cross-covariance matrix of the I audio channels and of the J audio sources and updating an auto-covariance matrix of the J audio sources, based on the updated Wiener filter matrix and based on an auto-covariance matrix of the I audio channels. The auto-covariance matrix of the I audio channels for frame n of the current clip may be determined from frames of the current clip and from frames of one or more previous clips and from frames of one or more future clips. For this purpose a buffer including a history buffer and a look-ahead buffer for the audio channels may be provided. The number of future clips may be limited (for example, to one future clip), thereby limiting the processing delay of the source separation method.

In addition, the method includes updating the mixing matrix and the power matrix based on the updated cross-covariance matrix of the I audio channels and of the J audio sources and/or based on the updated auto-covariance matrix of the J audio sources.

The updating steps may be repeated or iterated to determine the Wiener filter matrix, until a maximum number of iterations has been reached or until a convergence criteria with respect to the mixing matrix has been met. As a result of such an iterative process, a precise Wiener filter matrix may be determined, thereby providing a precise separation between the different audio sources.

The frequency domain may be subdivided into F frequency bins. On the other hand, the F frequency bins may be grouped or banded into $\bar{F}$ frequency bands, with $\bar{F}<F$. The processing may be performed on the frequency bands, on the frequency bins or in a mixed manner partially on the frequency bands and partially on the frequency bins. By way of example, the Wiener filter matrix may be determined for each of the F frequency bins, thereby providing a precise source separation. On the other hand, the auto-covariance matrix of the I audio channels and/or the power matrix of the J audio sources may be determined for F frequency bands only, thereby reducing the computational complexity of the source separation method.

As such, the frequency resolution of the Wiener filter matrix may be higher than the frequency resolution of one or more other matrices used within the iterative method for extracting the J audio sources. By doing this an improved tradeoff between precision and computational complexity may be provided. In particular example, the Wiener filter matrix may be updated for a resolution of frequency bins f using a mixing matrix at the resolution of frequency bins f and using a power matrix of the J audio sources at a reduced resolution of frequency bands $\bar{f}$ only. For this purpose, the below mentioned updating formula may be used $$\Omega_{\bar{f}n}=\Sigma_{S,\bar{f}n}A_{\bar{f}n}^{H}(A_{\bar{f}n}\Sigma_{S,\bar{f}n}A_{\bar{f}n}^{H}+\Sigma_{B})^{-1}.$$

Furthermore, the cross-covariance matrix $R_{XS,\bar{f}n}$ of the I audio channels and of the J audio sources and the auto-covariance matrix $R_{SS,\bar{f}n}$ of the J audio sources may be updated based on the updated Wiener filter matrix and based on the auto-covariance matrix $R_{XX,\bar{f}n}$ of the I audio channels. The updating may be performed at the reduced resolution of frequency bands $\bar{f}$ only. For this purpose, the frequency resolution of the Wiener filter matrix $\Omega_{\bar{f}n}$ may be reduced from the relative high frequency resolution of frequency bins f to the reduced frequency resolution of frequency bands $\bar{f}$ (e.g. by averaging corresponding Wiener filter matrix coefficients of the frequency bins belonging to one frequency band). The updating may be performed using the below mentioned formulas.

Furthermore, the mixing matrix $A_{\bar{f}n}$ and the power matrix $\Sigma_{S,\bar{f}n}$ may be updated based on the updated cross-covariance matrix $R_{XS,\bar{f}n}$ of the I audio channels and of the J audio sources and/or based on the updated auto-covariance matrix $R_{SS,\bar{f}n}$ of the J audio sources.

The Wiener filter matrix may be updated based on a noise power matrix comprising noise power terms, wherein the noise power terms may decrease with an increasing number of iterations. In other words, artificial noise may be inserted within the Wiener filter matrix and may be progressively reduced during the iterative process. As a result of this, the quality of the determined Wiener filter matrix may be increased.

For the frame n of the current clip and for the frequency bin f lying within a frequency band $\bar{f}$, the Wiener filter matrix may be updated based on or using $$\Omega_{\bar{f}n}=\Sigma_{S,\bar{f}n}A_{\bar{f}n}^{H}(A_{\bar{f}n}\Sigma_{S,\bar{f}n}A_{\bar{f}n}^{H}+\Sigma_{B})^{-1}.$$

wherein $\Omega_{\bar{f}n}$ is the updated Wiener filter matrix, wherein $\Sigma_{\bar{f}n}$ is the power matrix of the J audio sources, wherein $A_{\bar{f}n}$ is the mixing matrix and wherein $\Sigma_B$ is a noise power matrix (which may comprise the above-mentioned noise power terms). The above-mentioned formula may notably be used for the case I<J. Alternatively, the Wiener filter matrix may be updated based on or using $\Omega_{\bar{f}n}=(A_{\bar{f}n}^{H}\Sigma_{B}^{-1}A_{\bar{f}n}+\Sigma_{S,\bar{f}n}^{-1})^{-1}A_{\bar{f}n}^{H}\Sigma_{B}^{-1}$, notably for the case I≥J.

The Wiener filter matrix may be updated by applying an orthogonal constraint with regards to the J audio sources. By way of example, the Wiener filter matrix may be updated iteratively to reduce the power of non-diagonal terms of the auto-covariance matrix of the J audio sources, in order to render the estimated audio sources more orthogonal with respect to one another. In particular, the Wiener filter matrix may be updated iteratively using a gradient (notably, by iteratively reducing the gradient)

$$\frac{(\Omega_{\bar{f}n}R_{XX,\bar{f}n}\Omega_{\bar{f}n}^{H}-[\Omega_{\bar{f}n}R_{XX,\bar{f}n}\Omega_{\bar{f}n}^{H}]_{D})\Omega_{\bar{f}n}R_{XX,\bar{f}n}}{\|\Omega_{\bar{f}n}\|^{2}+\epsilon},$$

wherein $\Omega_{\bar{f}n}$ is the Wiener filter matrix for a frequency band $\bar{f}$ and for the frame n, wherein $R_{XX,\bar{f}n}$ is the auto-covariance matrix of the I audio channels, wherein $[\ ]_D$ is a diagonal matrix of a matrix included within the brackets, with all non-diagonal entries being set to zero and wherein $\epsilon$ is a small real number (for example, $10^{-12}$). By taking into account and by imposing the fact that the audio sources are decorrelated from one another, the quality of source separation may be improved further.

The cross-covariance matrix of the I audio channels and of the J audio sources may be updated based on or using $R_{XS,\bar{f}n}=R_{XX,\bar{f}n}\Omega_{\bar{f}n}^{H}$, wherein $R_{XS,\bar{f}n}$ is the updated cross-covariance matrix of the I audio channels and of the J audio sources for a frequency band $\bar{f}$ and for the frame n, wherein $\omega_{\bar{f}n}$ is the (updated) Wiener filter matrix, and wherein $R_{XX,\bar{f}n}$ is the auto-covariance matrix of the I audio channels. In a similar manner, the auto-covariance matrix of the J audio sources may be updated based on $R_{SS,\bar{f}n}=\Omega_{\bar{f}n}R_{XX,\bar{f}n}\Omega_{\bar{f}n}^{H}$, wherein $R_{SS,\bar{f}n}$ is the updated auto-covariance matrix of the J audio sources for a frequency band $\bar{f}$ and for the frame n.

Updating the mixing matrix may include determining a frequency-independent auto-covariance matrix $\bar{R}_{SS,n}$ of the J audio sources for the frame n, based on the auto-covariance matrices $R_{SS,\bar{f}n}$ of the J audio sources for the frame n and for different frequency bins f or frequency bands $\bar{f}$ of the frequency domain Furthermore, updating the mixing matrix may include determining a frequency-independent cross-covariance matrix $\bar{R}_{XS,n}$ of the I audio channels and of the J audio sources for the frame n based on the cross-covariance matrix $R_{XS,\bar{f}n}$ of the I audio channels and of the J audio sources for the frame n and for different frequency bins f or frequency bands $\bar{f}$ of the frequency domain. The mixing matrix $A_n$ for the frame n may then be determined in a frequency-independent manner based on or using $A_n=\bar{R}_{XS,n}\bar{R}_{SS,n}^{-1}$.

The method may include determining a frequency-dependent weighting term $e_{\bar{f}n}$ based on the auto-covariance matrix $R_{XX,\bar{f}n}$ of the I audio channels. The frequency-independent auto-covariance matrix $\bar{R}_{SS,n}$ and the frequency-independent cross-covariance matrix $\overline{R}_{XS,n}$ may then be determined based on the frequency-dependent weighting term $e_{fn}$, notably in order to put an increased emphasis on relatively loud frequency components of the audio sources. By doing this, the quality of source separation may be increased.

Updating the power matrix may include determining an updated power matrix term $(\Sigma_S)_{jj,fn}$ for the $j^{th}$ audio source for the frequency bin f and for the frame n based on or using $(\Sigma_S)_{jj,fn}=(R_{SS,\tilde{f}n})_{jj}$, wherein $R_{SS,\tilde{f}n}$ is the auto-covariance matrices of the J audio sources for the frame n and for a frequency band $\tilde{f}$ which includes the frequency bin f.

Furthermore, updating the power matrix may include determining a spectral signature W and a temporal signature H for the J audio sources using a non-negative matrix factorization of the power matrix. The spectral signature W and the temporal signature H for the $j^{th}$ audio source may be determined based on the updated power matrix term $(\Sigma_S)_{jj,fn}$ for the $j^{th}$ audio source. A further updated power matrix term $(\Sigma_S)_{jj,fn}$ for the $j^{th}$ audio source may be determined based on $(\Sigma_S)_{jj,fn}=\Sigma_k W_{j,fk}H_{j,kn}$, wherein k is the number or index of signatures. The power matrix may then be updated using the further updated power matrix terms for the J audio sources. The factorization of the power matrix may be used to impose one or more constraints (notably with regards to spectrum permutation) on the power matrix, thereby further increasing the quality of the source separation method.

The method may include initializing the mixing matrix (at the beginning of the iterative process for determining the Wiener filter matrix) using a mixing matrix determined for a frame (notably the last frame) of a clip directly preceding the current clip. Furthermore, the method may include initializing the power matrix based on the auto-covariance matrix of the I audio channels for frame n of the current clip and based on the Wiener filter matrix determined for a frame (notably the last frame) of the clip directly preceding the current clip. By making use of the results obtained for a previous clip for initializing the iterative process for the frames of the current clip, the convergence speed and quality of the iterative method may be increased.

According to a further aspect, a system for extracting J audio sources from I audio channels, with I, J>1, is described, wherein the audio channels include a plurality of clips, each clip comprising N frames, with N>1. The I audio channels are representable as a channel matrix in a frequency domain and the J audio sources are representable as a source matrix in the frequency domain. For a frame n of a current clip, for at least one frequency bin f, and for a current iteration, the system is adapted to update a Wiener filter matrix based on a mixing matrix, which is adapted to provide an estimate of the channel matrix from the source matrix, and based on a power matrix of the J audio sources, which is indicative of a spectral power of the J audio sources. The Wiener filter matrix is adapted to provide an estimate of the source matrix from the channel matrix. Furthermore, the system is adapted to update a cross-covariance matrix of the I audio channels and of the J audio sources and to updated an auto-covariance matrix of the J audio sources, based on the updated Wiener filter matrix and based on an auto-covariance matrix of the I audio channels. In addition, the system is adapted to update the mixing matrix and the power matrix based on the updated cross-covariance matrix of the I audio channels and of the J audio sources, and/or based on the updated auto-covariance matrix of the J audio sources.

According to a further aspect, a software program is described. The software program may be adapted for execution on a processor and for performing the method steps outlined in the present document when carried out on the processor.

According to another aspect, a storage medium is described. The storage medium may include a software program adapted for execution on a processor and for performing the method steps outlined in the present document when carried out on the processor.

According to a further aspect, a computer program product is described. The computer program may include executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

BRIEF DESCRIPTION OF THE DRAWINGS

The invention is explained below in an exemplary manner with reference to the accompanying drawings, wherein.

DETAILED DESCRIPTION

Figure 3:
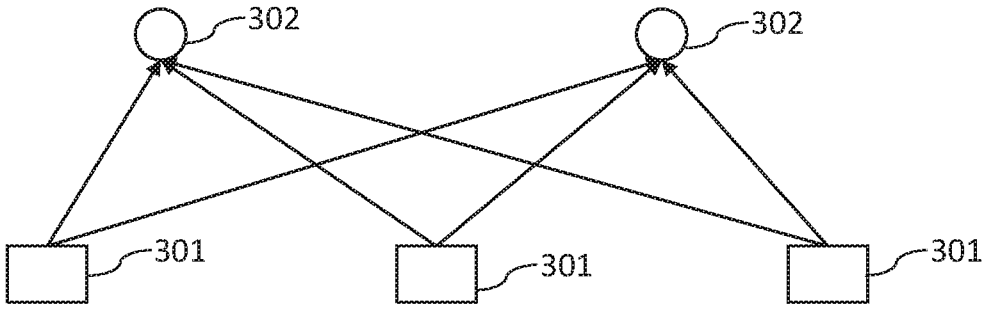
FIG. 3 shows an example scenario with a plurality of audio sources and a plurality of audio channels of a multi-channel signal.

As outlined above, the present document is directed at the separation of audio sources from a multi-channel audio signal, notably for real-time applications. FIG. 3 illustrates an example scenario for source separation. In particular, FIG. 3 illustrates a plurality of audio sources 301 which are positioned at different positions within an acoustic environment. Furthermore, a plurality of audio channels 302 is captured by microphones at different places within the acoustic environment. It is an object of source separation to derive the audio sources 301 from the audio channels 302 of a multi-channel audio signal.

The document uses the nomenclature described in Table 1.

TABLE 1

| Notation | Physical meaning | Typical value |
|---|---|---|
| $T_R$ | frames of each window over which the covariance matrix is calculated | 32 |
| N | frames of each clip, recommended to be $T_R/2$ so that half-overlapped with the window over which the last Wiener filter parameter is estimated | 8 |
| $\omega_{len}$ | samples in each frame | 1024 |
| F | frequency bins in STFT domain | $1+\frac{\omega_{len}}{2}=513$ |
| $\overline{F}$ | frequency bands in STFT domain | 20 |
| I | number of mix channels | 5, or 7 |
| J | number of sources | 3 |
| K | NMF components of each source | 24 |
| ITR | maximum iterations | 40 |

TABLE 1-continued

| Notation | Physical meaning | Typical value |
|---|---|---|
| $\Gamma$ | criteria threshold for terminating iterations | 0.01 |
| $ITR_{ortho}$ | maximum iterations for orthogonal constraints | 20 |
| $\alpha_1$ | gradient step length for orthogonal constraints | 2.0 |
| $\rho$ | forgetting factor for online NMF update | 0.99 |

Furthermore, the present document makes use of the following notation:

Covariance matrices may be denoted as $R_{XX}$, $R_{SS}$, $R_{XS}$, etc., and the corresponding matrices which are obtained by zeroing all non-diagonal terms of the covariance matrices may be denoted as $\Sigma_X$, $\Sigma_S$, etc.

The operator $\|\cdot\|$ may be used for denoting the L2 norm for vectors and the Frobenius norm for matrices. In both cases, the operator typically consists in the square root of the sum of the square of all the entries.

The expression A. B may denote the element-wise product of two matrices A and B. Furthermore, the expression $$\frac{A}{B}$$

may denote the element-wise division, and the expression $B^{-1}$ may denote a matrix inversion.

The expression $B^H$ may denote the transpose of B, if B is a real-valued matrix, and may denote the conjugate transpose of B, if B is a complex-valued matrix.

An I-channel multi-channel audio signal includes I different audio channels 302, each being a convolutive mixture of I audio sources 301 plus ambience and noise, $$x_i(t) = \sum_{j=1}^{J} \sum_{\tau=0}^{L-1} a_{ij}(\tau) s_{ij}(t-\tau) + b_i(t) \tag{1}$$

where $x_i(t)$ is the i-th time domain audio channel 302, with i=1, . . . , I and t=1, . . . , T. $s_j(t)$ is the j-th audio source 301, with j=1, . . . , J, and it is assumed that the audio sources 301 are uncorrelated to each other; $b_i(t)$ is the sum of ambiance signals and noise (which may be referred to jointly as noise for simplicity), wherein the ambiance and noise signals are uncorrelated to the audio sources 301; $a_{ij}(\tau)$ are mixing parameters, which may be considered as finite-impulse responses of filters with path length L.

If the STFT (short term Fourier transform) frame size $\omega_{len}$ is substantially larger than the filter path length L, a linear circular convolution mixing model may be approximated in the frequency domain, as $$X_{fn}=A_{fn}S_{fn}+B_{fn} \tag{2}$$

where $X_{fn}$ and $B_{fn}$ are I×1 matrices, $A_{fn}$ are I×J matrices, and $S_{fn}$ are J×1 matrices, being the STFTs of the audio channels 302, the noise, the mixing parameters and the audio sources 301, respectively. $X_{fn}$ may be referred to as the channel matrix, $S_{fn}$ may be referred to as the source matrix and $A_{fn}$ may be referred to as the mixing matrix.

A special case of the convolution mixing model is an instantaneous mixing type, where the filter path length L=1, such that:

$$a_{ij}(\tau)=0,\ (\forall\tau\neq 0) \tag{3}$$

In the frequency domain, the mixing parameters A are frequency-independent, meaning that equation (3) is identical to $A_{fn}=A_n$; ($\forall$f=1, . . . , F), and real. Without loss of generality and extendibility, the instantaneous mixing type will be described in the following.

Figure 1:
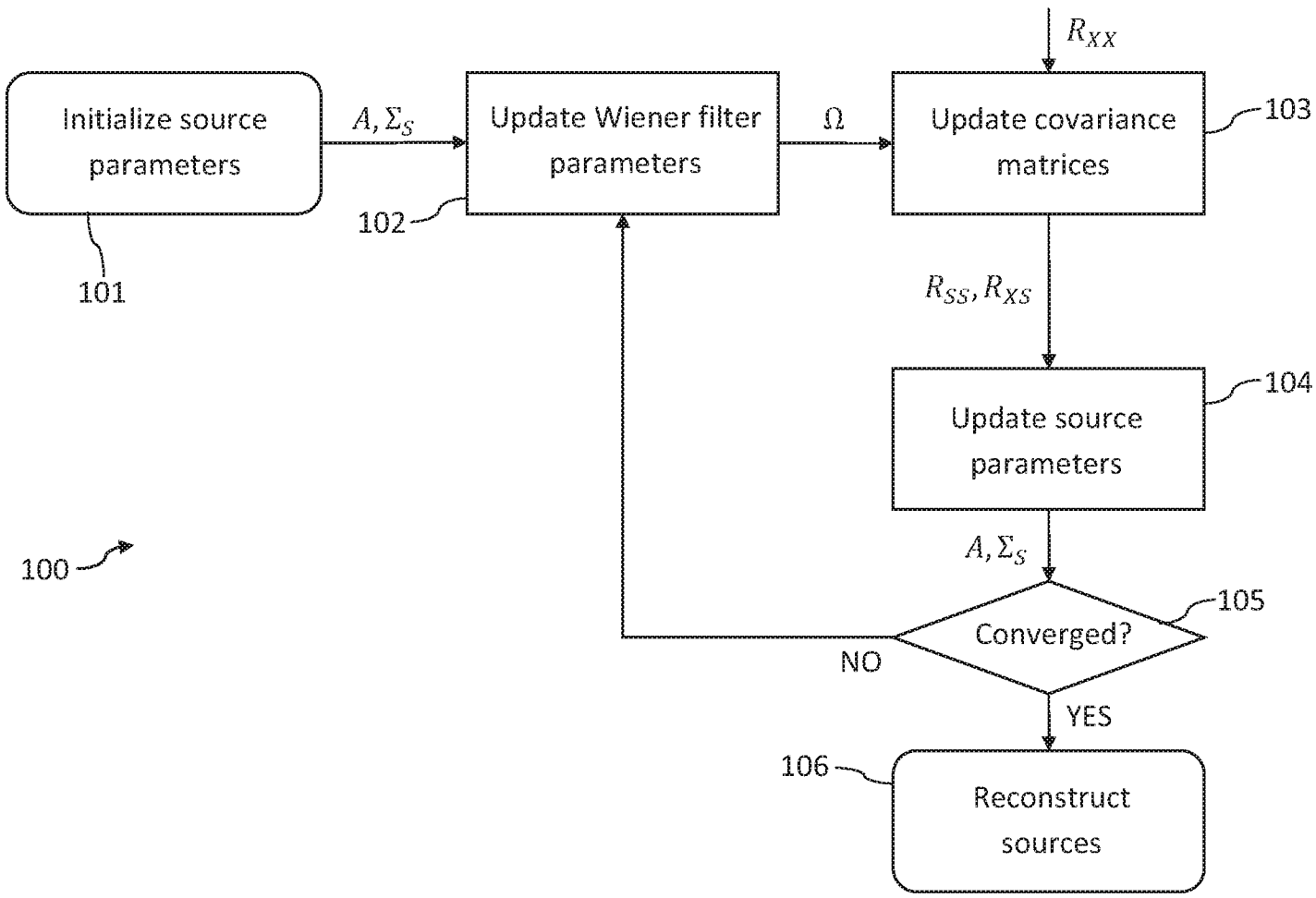
FIG. 1 shows a flow chart of an example method for performing source separation.

FIG. 1 shows a flow chart of an example method 100 for determining the J audio sources $s_j(t)$ from the audio channels $x_i(t)$ of an I-channel multi-channel audio signal. In a first step 101, source parameters are initialized. In particular, initial values for the mixing parameters $A_{ij,fn}$ may be selected. Furthermore, the spectral power matrices $(\Sigma_S)_{jj,fn}$ indicating the spectral power of the J audio sources for different frequency bands f and for different frames n of a clip of frames may be estimated.

The initial values may be used to initialize an iterative scheme for updating parameters until convergence of the parameters or until reaching the maximum allowed number of iterations ITR. A Wiener filter $S_{fn}=\Omega_{fn}X_{fn}$ may be used to determine the audio sources 301 from the audio channels 302, wherein $\Omega_{fn}$ are the Wiener filter parameters or the un-mixing parameters (included within a Wiener filter matrix). The Wiener filter parameters $\Omega_{fn}$ within a particular iteration may be calculated or updated using the values of the mixing parameters $A_{ij,fn}$ and of the spectral power matrices $(\Sigma_S)_{jj,fn}$, which have been determined within the previous iteration (step 102). The updated Wiener filter parameters $\Omega_{fn}$ may be used to update 103 the auto-covariance matrices $R_{SS}$ of the audio sources 301 and the cross-covariance matrix $R_{XS}$ of the audio sources and the audio channels. The updated covariance matrices may be used to update the mixing parameters $A_{ij,fn}$ and the spectral power matrices $(\Sigma_S)_{jj,fn}$ (step 104). If a convergence criteria is met (step 105), the audio sources may be reconstructed (step 106) using the converged Wiener filter $\Omega_{fn}$. If the convergence criteria is not met (step 105) the Wiener filter parameters $\Omega_{fn}$ may be updated in step 102 for a further iteration of the iterative process.

Figure 2:
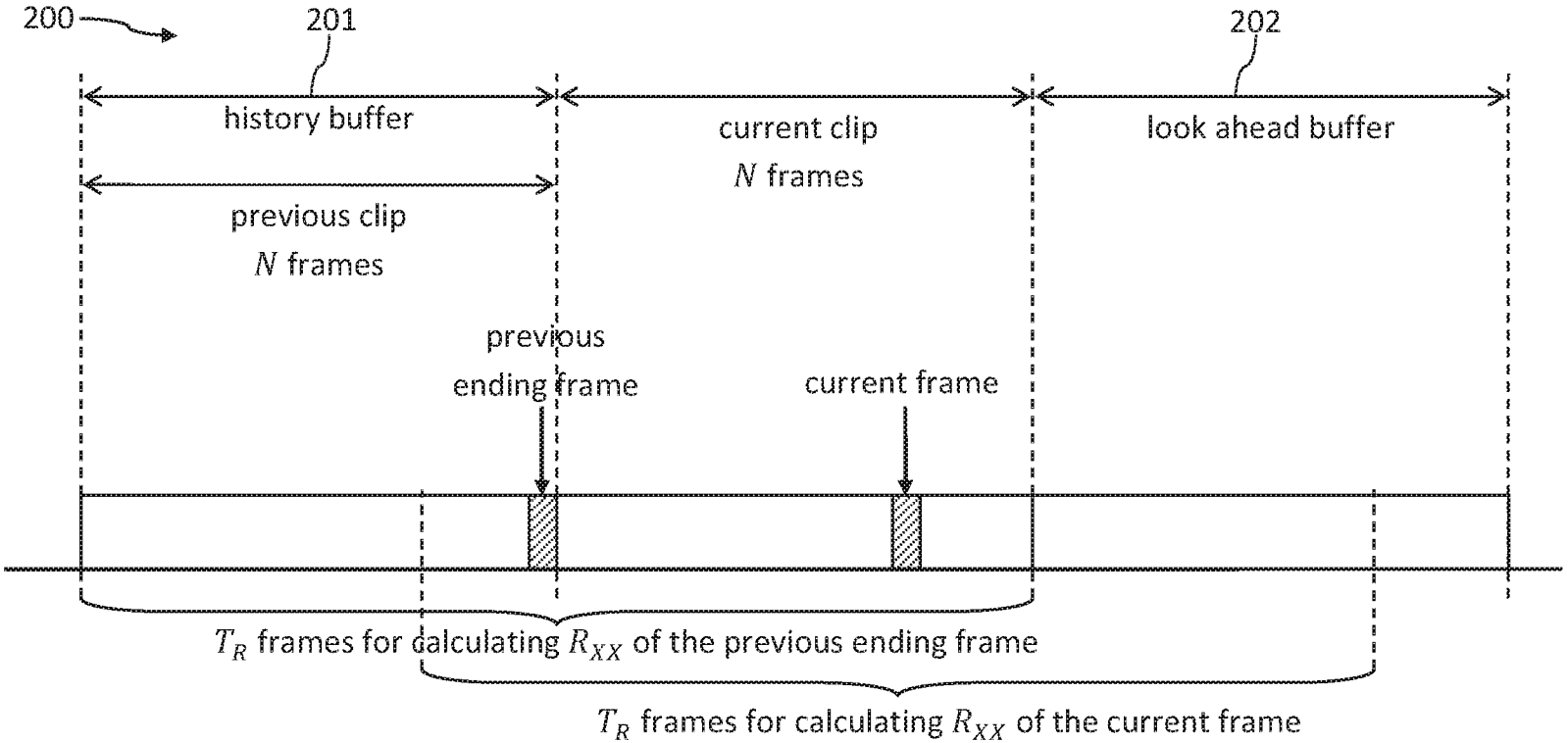
FIG. 2 illustrates the data used for processing the frames of a particular clip of audio data.

The method 100 may be applied to a clip of frames of a multi-channel audio signal, wherein a clip includes N frames. As shown in FIG. 2, for each clip, a multi-channel audio buffer 200 may include $(N+T_R)$ frames in total, including N frames of the current clip, $$\left(\frac{T_R}{2}-1\right)$$

frames of one or more previous clips (as history buffer 201) and $$\left(\frac{T_R}{2}+1\right)$$

frames or one or more future clips (as look-ahead buffer 202). This buffer 200 is maintained for determining the covariance matrices.

In the following, a scheme for initializing the source parameters is described. The time-domain audio channels 302 are available and a relatively small random noise may be added to the input in the time-domain to obtain (possibly noisy) audio channels $x_i(t)$. A time-domain to frequency-domain transform is applied (for example, an STFT) to obtain $X_{fn}$. The instantaneous covariance matrices of the audio channels may be calculated as $$R_{XX,fn}^{inst}=X_{fn}X_{fn}^H,\ n=1, \ldots, N+T_R-1 \tag{4}$$

The covariance matrices for different frequency bins and for different frames may be calculated by averaging over $T_R$ frames:

$$R_{XX,fn} = \frac{1}{T_R} \sum_{m=n}^{N+T_R-1} R_{XX,fm}^{inst},\ n = 1, \ldots, N \tag{5}$$

A weighting window may be applied optionally to the summing in equation (5) so that information which is closer to the current frame is given more importance.

$R_{XX,fn}$ may be grouped to band-based covariance matrices $R_{XX,\tilde{f}n}$ by summing over individual frequency bins f=1, . . . , F to provided corresponding frequency bands $\tilde{f}$=1, . . . , $\tilde{F}$. Example banding mechanisms include Octave band and ERB (equivalent rectangular bandwidth) bands. By way of example, 20 ERB bands with banding boundaries [0, 1, 3, 5, 8, 11, 15, 20, 27, 35, 45, 59, 75, 96, 123, 156, 199, 252, 320, 405, 513] may be used. Alternatively, 56 Octave bands with banding boundaries [0, 1, 2, 3, 4, 5, 6, 7, 8, 9, 10, 11, 12, 13, 14, 15, 16, 18, 20, 22, 24, 26, 28, 30, 32, 36, 40, 44, 48, 52, 56, 60, 64, 72, 80, 88, 96, 104, 112, 120, 128, 144, 160, 176, 192, 208, 224, 240, 256, 288, 320, 352, 384, 416, 448, 480, 513] may be used to increase frequency resolution (for example, when using a 513 point STFT). The banding may be applied to any of the processing steps of the method 100. In the present document, the individual frequency bins f may be replaced by frequency bands $\tilde{f}$ (if banding is used).

Using the input covariance matrices $R_{XX,fn}$ logarithmic energy values may be determined for each time-frequency (TF) tile, meaning for each combination of frequency bin f and frame n. The logarithmic energy values may then be normalized or mapped to a [0, 1] Interval:

$$e_{fn} = \log_{10} \sum_i (R_{XX})_{ii,fn}, \tag{6}$$

$$e_{fn} \leftarrow \left( \frac{e_{fn} - \min_f(e_{fn})}{\max_f(e_{fn}) - \min_f(e_{fn})} \right)^{\alpha}$$

where α may be set to 2.5, and typically ranges from 1 to 2.5. The normalized logarithmic energy values $e_{fn}$ may be used within the method 100 as the weighting factor for the corresponding TF tile for updating the mixing matrix A (see equation 18).

The covariance matrices of the audio channels 302 may be normalized by the energy of the mix channels per TF tiles, so that the sum of all normalized energies of the audio channels 302 for a given TF tile is one:

$$R_{XX,fn} \leftarrow \frac{R_{XX,fn}}{\mathrm{trace}(R_{XX,fn}) + \varepsilon_1} \tag{7}$$

where $\varepsilon_1$ is a relatively small value (for example, $10^{-6}$) to avoid division by zero, and trace(·) returns the sum of the diagonal entries of the matrix within the bracket.

Initialization for the sources' spectral power matrices differs from the first clip of a multi-channel audio signal to other following clips of the multi-channel audio signal:

For the first clip, the sources' spectral power matrices (for which only diagonal elements are non-zero) may be initialized with random Non-negative Matrix Factorization (NMF) matrices W, H (or pre-learned values for W, H, if available):

$$\left(\sum_S\right)_{jj,fn} = \sum_k W_{j,fk} H_{j,kn},\ n \in \text{first chip} \tag{8}$$

where by way of example: $W_{j,fk}$=0.75|rand (j, fk)|+0.25 and $H_{j,kn}$=0.75|rand (j,kn)|+0.25. The two matrices for updating $W_{j,fk}$ in equation (22) may also be initiated with random values: $(W_A)_{j,fk}$=0.75|rand(j, fk)|+0.25 and $(W_B)_{j,fk}$=0.75|rand(j, fk)|+0.25.

For any following clips, the sources' spectral power matrices may be initialized by applying the previously estimated Wiener filter parameters SI for the previous clip to the covariance matrices of the audio channels 302:

$$(\Sigma_S)_{jj,fn} = (\Omega R_{XX} \Omega^H)_{jj,fn} + \varepsilon_2 |\mathrm{rand}(j)| \tag{9}$$

where Ω may be the estimated Wiener filter parameters for the last frame of the previous clip. $\varepsilon_2$ may be a relatively small value (for example, $10^{-6}$) and rand(j)~N(1.0, 0.5) may be a Gaussian random value. By adding a small random value, a cold start issue may be overcome in case of very small values of $(\Omega R_{XX} \Omega^H)_{jj,fn}$. Furthermore, global optimization may be favored.

Initialization for the mixing parameters A may be done as follows: For the first clip, for the multi-channel instantaneous mixing type, the mixing parameters may be initialized:

$$A_{ij,fn} = |\mathrm{rand}(i, j)|,\ f,\ n \tag{10}$$

and then normalized:

$$A_{ij,fn} \leftarrow \begin{cases} \dfrac{A_{ij,fn}}{\sum_i A_{ij,fn}^2} & \text{if } \sum_i A_{ij,fn}^2 > 10^{-12} \\ \dfrac{1}{\sqrt{I}} & \text{else} \end{cases} \tag{11}$$

For the stereo case, meaning for a multi-channel audio signal including I=2 audio channels, with the left channel L being i=1 and with the right channel R: i=2, one may explicitly apply the below formulas $$A_{1j,fn} = \left|\sin\left(j\frac{\pi}{2(J+1)}\right)\right|,\ A_{2j,fn} = \left|\cos\left(j\frac{\pi}{2(J+1)}\right)\right| \tag{12}$$

For the subsequent clips of the multi-channel audio signal, the mixing parameters may be initialized with the estimated values from the last frame of the previous clip of the multi-channel audio signal.

In the following, updating the Wiener filter parameters is outlined. The Wiener filter parameters may be calculated:

$$\Omega_{\tilde{f}n} = \Sigma_{S,\tilde{f}n} A_{fn}^H (A_{fn} \Sigma_{S,\tilde{f}n} A_{fn}^H + \Sigma_B)^{-1} \tag{13}$$

where the $\Sigma_{S,\tilde{f}n}$ are calculated by summing $\Sigma_{S,fn}$, f=1, . . . , F for corresponding frequency bands $\tilde{f}$=1, . . . , $\tilde{F}$. Equation (13) may be used for determining the Wiener filter parameters notably for the case where I<J.

The noise covariance parameters $\Sigma_B$ may be set to iteration-dependant common values, which do not exhibit frequency dependency or time dependency, as the noise is assumed to be white and stationary $$\sum_B (iter) = \left(\frac{0.1}{\sqrt{I}}\frac{ITR-iter}{ITR}+\frac{0.01}{\sqrt{I}}\frac{iter}{ITR}\right)^2 = \frac{1}{100I\cdot ITR^2}\left(ITR-\frac{9}{10}iter\right)^2 \quad (14)$$

The values change in each iteration iter, from an initial value 1/100I to a final smaller value /10000I. This operation is similar to simulated annealing which favors fast and global convergence.

The inverse operation for calculating the Wiener filter parameters is to be applied to an I×I matrix. In order to avoid the computations for matrix inversions, in the case J≤I, instead of equation (13), Woodbury matrix identity may be used for calculating the Wiener filter parameters using $$\Omega_{\tilde{f}n}=(A_{fn}^H\Sigma_B^{-1}A_{fn}+\Sigma_{S,\tilde{f}n}^{-1})^{-1}A_{fn}^H\Sigma_B^{-1} \quad (15)$$

It may be shown that equation (15) is mathematically equivalent to equation (13).

Under the assumption of uncorrelated audio sources, the Wiener filter parameters may be further regulated by iteratively applying the orthogonal constraints between the sources:

$$\Omega_{\tilde{f}n} \leftarrow \Omega_{\tilde{f}n} - \alpha_1 \frac{\left(\Omega_{\tilde{f}n}R_{XX,\tilde{f}n}\Omega_{\tilde{f}n}^H - \left[\Omega_{\tilde{f}n}R_{XX,\tilde{f}n}\Omega_{\tilde{f}n}^H\right]_D\right)\Omega_{\tilde{f}n}R_{XX,\tilde{f}n}}{\left\|\Omega_{\tilde{f}n}\right\|^2+\epsilon} \quad (16)$$

where the expression $[\cdot]_D$ indicates the diagonal matrix, which is obtained by setting all non-diagonal entries zero and where ε may be $\varepsilon=10^{-12}$ or less. The gradient update is repeated until convergence is achieved or until reaching a maximum allowed number $ITR_{ortho}$ of iterations. Equation (16) uses an adaptive decorrelation method.

The covariance matrices may be updated (step 103) using the following equations $$R_{XS,\tilde{f}n}=R_{XX,\tilde{f}n}\Omega_{\tilde{f}n}^H,$$

$$R_{SS,\tilde{f}n}=\Omega_{\tilde{f}n}R_{XX,\tilde{f}n}\Omega_{\tilde{f}n}^H \quad (17)$$

In the following, a scheme for updating the source parameters is described (step 104). Since the instantaneous mixing type is assumed, the covariance matrices can be summed over frequency bins or frequency bands for calculating the mixing parameters. Moreover, weighting factors as calculated in equation (6) may be used to scale the TF tiles so that louder components within the audio channels 302 are given more importance:

$$\overline{R}_{XS,n} = \sum_f e_{fn}R_{XS,\tilde{f}n}, \quad (18)$$

$$\overline{R}_{SS,n} = \sum_f e_{fn}R_{SS,\tilde{f}n}$$

Given an unconstrained problem, the mixing parameters can be determined by matrix inversions $$A_n=\overline{R}_{XS,n}\overline{R}_{SS,n}^{-1} \quad (19)$$

Furthermore, the spectral power of the audio sources 301 may be updated In this context, the application of a non-negative matrix factorization (NMF) scheme may be beneficial to take into account certain constraints or properties of the audio sources 301 (notably with regards to the spectrum of the audio sources 301). As such, spectrum constraints may be imposed through NMF when updating the spectral power. NMF is particularly beneficial when prior-knowledge about the audio sources' spectral signature (W) and/or temporal signature (H) is available. In cases of blind source separation (BSS), NMF may also have the effect of imposing certain spectrum constraints, such that spectrum permutation (meaning that spectral components of one audio source are split into multiple audio sources) is avoided and such that a more pleasing sound with less artifacts is obtained.

The audio sources' spectral power $\Sigma_S$ may be updated using $$(\Sigma_S)_{jj,\tilde{f}n}=(R_{SS,\tilde{f}n})_{jj} \quad (20)$$

Subsequently, the audio sources' spectral signature $W_{j,fk}$ and the audio sources' temporal signature $H_{j,kn}$ may be updated for each audio source j based on $(\Sigma_S)_{jj,\tilde{f}n}$. For simplicity, the terms are denoted as W, H, and $\Sigma_S$ in the following (meaning without indexes). The audio sources' spectral signature W may be updated only once every clip for stabilizing the updates and for reducing computation complexity compared to updating W for every frame of a clip.

As an input to the NMF scheme, $\Sigma_S$, W, $W_A$, $W_B$ and H are provided. The following equations (21) up to (24) may then be repeated until convergence or until a maximum number of iterations is achieved. First the temporal signature may be updated:

$$H \leftarrow H\cdot\left[\frac{W^H\left(\left(\sum_S+\varepsilon_4 1\right)\cdot(WH+\varepsilon_4 1)^{-2}\right)}{W^H(WH+\varepsilon_4 1)^{-1}}\right] \quad (21)$$

with $\varepsilon_4$ being small, for example $10^{-12}$. Then, $W_A$, $W_B$ may be updated $$W_A \leftarrow W_A + \rho W^2\cdot\left[\frac{\sum_S+\varepsilon_4 1}{(WH+\varepsilon_4 1)^2}H^H\right] \quad (22)$$

$$W_B \leftarrow W_B + \rho\left[\frac{1}{WH+\varepsilon_4 1}H^H\right]$$

and W may be updated $$W = \sqrt{\frac{W_A}{W_B}} \quad (23)$$

and W, $W_A$, $W_B$ may be re-normalized $$\overline{W}_k = \sum_f W_{f,k} \quad (24)$$

$$W_{f,k} \leftarrow \frac{W_{f,k}}{\overline{W}_k}$$

$$(W_A)_{f,k} \leftarrow \frac{(W_A)_{f,k}}{\overline{W}_k}$$

$$(W_B)_{f,k} \leftarrow (W_B)_{f,k}\overline{W}_k$$

As such, updated W, $W_A$, $W_B$ and H may be determined in an iterative manner, thereby imposing certain constraints regarding the audio sources. The updated W, $W_A$, $W_B$ and H may then be used to refine the audio sources' spectral power $\Sigma_S$ using equation (8).

In order to remove scale ambiguity, A, W and H (or A and $\Sigma_S$) may be re-normalized:

$$E_{1,jn} = \sum_i A_{ij,n}^2,\ E_{2,jk} = \sum_f W_{j,fk} \tag{25}$$

$$A_{ij,fn} \leftarrow \begin{cases} \dfrac{A_{ij,fn}}{\sqrt{E_{1,jn}}} & \text{if } E_{1,jn} > 10^{-12} \\ \dfrac{1}{\sqrt{I}} & \text{else} \end{cases}$$

$$W_{j,fk} \leftarrow \frac{W_{j,fk}}{E_{2,jk}}$$

$$H_{j,kn} \leftarrow H_{j,kn} \times E_{1,jn} \times E_{2,jk}$$

Through re-normalization, A conveys energy-preserving mixing gains among channels ($\Sigma_i A_{ij,n}^2=1$), and W is also energy-independent and conveys normalized spectral signatures. Meanwhile the overall energy is preserved as all energy-related information is relegated into the temporal signature H. It should be noted that this renormalization process preserves the quantity that scales the signal: $A\sqrt{WH}$. The sources' spectral power matrices $\Sigma_s$ may be refined with NMF matrices W and H using equation (8).

The stop criteria which is used in step 105 may be given by $$\frac{\sum_n \|A^{new} - A^{old}\|_F}{\sum_n \|A^{new}\|_F} < \Gamma \tag{26}$$

The individual audio sources 301 may be reconstructed using the Wiener filter:

$$S_{fn} = \Omega_{fn} X_{fn} \tag{27}$$

where $\Omega_{fn}$ may be re-calculated for each frequency bin using equation (13) (or equation (15)). For source reconstruction, it is typically beneficial to use a relatively fine frequency resolution, so it is typically preferable to determine $\Omega_{fn}$ based on individual frequency bins f instead of frequency bands $\bar{f}$.

Multi-channel (I-channel) sources may then be reconstructed by panning the estimated audio sources with the mixing parameters:

$$\bar{S}_{ij,fn} = A_{ij,n} S_{j,fn} \tag{28}$$

where $\bar{S}_{ij,fn}$ are a set of J vectors, each of size I, denoting the STFT of the multi-channel sources. By Wiener filter's conservativity, the reconstruction guarantees that the multi-channel sources and the noise sum up to the original audio channels:

$$\sum_j \bar{S}_{ij,fn} + B_{i,fn} = X_{i,fn} \tag{29}$$

Due to the linearity of the inverse STFT, the conservativity also holds in the time-domain.

The methods and systems described in the present document may be implemented as software, firmware and/or hardware. Certain components may for example be implemented as software running on a digital signal processor or microprocessor. Other components may for example be implemented as hardware and or as application specific integrated circuits. The signals encountered in the described methods and systems may be stored on media such as random access memory or optical storage media. They may be transferred via networks, such as radio networks, satellite networks, wireless networks or wireline networks, for example the Internet. Typical devices making use of the methods and systems described in the present document are portable electronic devices or other consumer equipment which are used to store and/or render audio signals.

Various aspects of the present invention may be appreciated from the following enumerated example embodiments (EEEs):

EEE 1. A method (100) for extracting J audio sources (301) from I audio channels (302), with I, J>1, wherein the audio channels (302) comprise a plurality of clips, each clip comprising N frames, with N>1, wherein the I audio channels (302) are representable as a channel matrix in a frequency domain, wherein the J audio sources (301) are representable as a source matrix in the frequency domain, wherein the method (100) comprises, for a frame n of a current clip, for at least one frequency bin f, and for a current iteration, updating (102) a Wiener filter matrix based on a mixing matrix, which is configured to provide an estimate of the channel matrix from the source matrix, and a power matrix of the J audio sources (301), which is indicative of a spectral power of the J audio sources (301);

wherein the Wiener filter matrix is configured to provide an estimate of the source matrix from the channel matrix;

updating (103) a cross-covariance matrix of the I audio channels (302) and of the J audio sources (301) and an auto-covariance matrix of the J audio sources (301), based on the updated Wiener filter matrix; and an auto-covariance matrix of the I audio channels (302); and updating (104) the mixing matrix and the power matrix based on the updated cross-covariance matrix of the I audio channels (302) and of the J audio sources (301), and/or the updated auto-covariance matrix of the J audio sources (301).

EEE 2. The method (100) of EEE 1, wherein the method (100) comprises determining the auto-covariance matrix of the I audio channels (302) for frame n of a current clip from frames of one or more previous clips and from frames of one or more future clips.

EEE 3. The method (100) of any previous EEE, wherein the method (100) comprises determining the channel matrix by transforming the I audio channels (302) from a time domain to the frequency domain.

EEE 4. The method (100) of EEE 3, wherein the channel matrix is determined using a short-term Fourier transform.

EEE 5. The method (100) of any previous EEE, wherein the method (100) comprises determining an estimate of the source matrix for the frame n of the current clip and for at least one frequency bin f as $S_{fn}=\Omega_{fn}X_{fn}$;

$S_{fn}$ is an estimate of the source matrix;

$\Omega_{fn}$ is the Wiener filter matrix; and $X_{fn}$ is the channel matrix.

EEE 6. The method (100) of any previous EEE, wherein the method (100) comprises performing the updating steps (102, 103, 104) to determine the Wiener filter matrix, until a maximum number of iterations has been reached or until a convergence criteria with respect to the mixing matrix has been met.

EEE 7. The method (100) of any previous EEE, wherein the frequency domain is subdivided into F frequency bins;

the Wiener filter matrix is determined for F frequency bins;

the F frequency bins are grouped into $\bar{F}$ frequency bands, with $\bar{F}<F$;

the auto-covariance matrix of the I audio channels (302) is determined for $\bar{F}$ frequency bands; and the power matrix of the J audio sources (301) is determined for $\bar{F}$ frequency bands.

EEE 8. The method (100) of any previous EEE, wherein the Wiener filter matrix is updated based on a noise power matrix comprising noise power terms; and the noise power terms decrease with an increasing number of iterations.

EEE 9. The method (100) of any previous EEE, wherein for the frame n of the current clip and for the frequency bin f lying within a frequency band $\bar{f}$, the Wiener filter matrix is updated based on $\Omega_{fn}=\Sigma_{S,\bar{f}n}A_{fn}^{H}(A_{fn}\Sigma_{S,\bar{f}n}A_{fn}^{H}+\Sigma_{B})^{-1}$ for I<J, or based on $\Omega_{\bar{f}n}=(A_{fn}^{H}\Sigma_{B}^{-1}A_{fn}+\Sigma_{S,\bar{f}n}^{-1})^{-1}A_{fn}^{H}\Sigma_{B}^{-1}$ for I≥J;

$\Omega_{fn}$ is the updated Wiener filter matrix;

$\Sigma_{\bar{f}n}$ is the power matrix of the J audio sources (301);

$A_{fn}$ is the mixing matrix; and $\Sigma_{B}$ is a noise power matrix.

EEE 10. The method (100) of any previous EEE, wherein the Wiener filter matrix is updated by applying an orthogonal constraint with regards to the J audio sources (301).

EEE 11. The method (100) of EEE 10, wherein the Wiener filter matrix is updated iteratively to reduce the power of non-diagonal terms of the auto-covariance matrix of the J audio sources (301).

EEE 12. The method (100) of any of EEEs 10 to 11, wherein the Wiener filter matrix is updated iteratively using a gradient $$\frac{(\Omega_{\bar{f}n}R_{XX,\bar{f}n}\Omega_{\bar{f}n}^{H}-[\Omega_{\bar{f}n}R_{XX,\bar{f}n}\Omega_{\bar{f}n}^{H}]_{D})\Omega_{\bar{f}n}R_{XX,\bar{f}n}}{\|\Omega_{\bar{f}n}\|^{2}+\epsilon};$$

$\Omega_{\bar{f}n}$ is the Wiener filter matrix for a frequency band $\bar{f}$ and for the frame n;

$R_{XX,\bar{f}n}$ is the auto-covariance matrix of the I audio channels (302);

$[\ ]_{D}$ is a diagonal matrix of a matrix included within the brackets, with all non-diagonal entries being set to zero; and $\epsilon$ is a real number.

EEE 13. The method (100) of any previous EEE, wherein the cross-covariance matrix of the I audio channels (302) and of the J audio sources (301) is updated based on $R_{XS,\bar{f}n}=R_{XX,\bar{f}n}\Omega_{\bar{f}n}^{H}$;

$R_{XS,\bar{f}n}$ is the updated cross-covariance matrix of the I audio channels (302) and of the J audio sources (301) for a frequency band $\bar{f}$ and for the frame n;

$\Omega_{\bar{f}n}$ is the Wiener filter matrix; and $R_{XX,\bar{f}n}$ is the auto-covariance matrix of the I audio channels (302).

EEE 14. The method (100) of any previous EEE, wherein the auto-covariance matrix of the J audio sources (301) is updated based on $R_{SS,\bar{f}n}=\Omega_{\bar{f}n}R_{XX,\bar{f}n}\Omega_{\bar{f}n}^{H}$;

$R_{SS,\bar{f}n}$ is the updated auto-covariance matrix of the J audio sources (301) for a frequency band $\bar{f}$ and for the frame n;

$\Omega_{\bar{f}n}$ is the Wiener filter matrix; and $R_{XX,\bar{f}n}$ is the auto-covariance matrix of the I audio channels (302).

EEE 15. The method (100) of any previous EEE, wherein updating (104) the mixing matrix comprises, determining a frequency-independent auto-covariance matrix $\bar{R}_{SS,n}$ of the J audio sources (301) for the frame n, based on the auto-covariance matrices $R_{SS,\bar{f}n}$ of the J audio sources (301) for the frame n and for different frequency bins f or frequency bands $\bar{f}$ of the frequency domain; and determining a frequency-independent cross-covariance matrix $\bar{R}_{XS,n}$ of the I audio channels (302) and of the J audio sources (301) for the frame n based on the cross-covariance matrix $R_{XS,\bar{f}n}$ of the I audio channels (302) and of the J audio sources (301) for the frame n and for different frequency bins f or frequency bands $\bar{f}$ of the frequency domain.

EEE 16. The method (100) of EEE 15, wherein the mixing matrix is determined based on $A_{n}=\bar{R}_{XS,n}\bar{R}_{SS,n}^{-1}$;

$A_{n}$ is the frequency-independent mixing matrix for the frame n.

EEE 17. The method (100) of any of EEEs 15 to 16, wherein the method comprises determining a frequency-dependent weighting term $e_{fn}$ based on the auto-covariance matrix $R_{XX,\bar{f}n}$ of the I audio channels (302); and the frequency-independent auto-covariance matrix $\bar{R}_{SS,n}$ and the frequency-independent cross-covariance matrix $\bar{R}_{XS,n}$ are determined based on the frequency-dependent weighting term $e_{fn}$.

EEE 18. The method (100) of any previous EEE, wherein updating (104) the power matrix comprises determining an updated power matrix term $(\Sigma_{s})_{jj,fn}$ for the $j^{th}$ audio source (301) for the frequency bin f and for the frame n based on $(\Sigma_{s})_{jj,fn}=(R_{SS,\bar{f}n})_{jj}$; and $R_{SS,\bar{f}n}$ is the auto-covariance matrices of the J audio sources (301) for the frame n and for a frequency band $\bar{f}$ which comprises the frequency bin f.

EEE 19. The method (100) of EEE 18, wherein updating (104) the power matrix comprises determining a spectral signature W and a temporal signature H for the J audio sources (301) using a non-negative matrix factorization of the power matrix;

the spectral signature W and the temporal signature H for the $j^{th}$ audio source (301) are determined based on the updated power matrix term $(\Sigma_{s})_{jj,fn}$ for the $j^{th}$ audio source (301); and updating (104) the power matrix comprises determining a further updated power matrix term $(\Sigma_{s})_{jj,fn}$ for the $j^{th}$ audio source (301) based on $(\Sigma_{s})_{jj,fn}=\Sigma_{k}W_{j,fk}H_{j,kn}$.

EEE 20. The method (100) of any previous EEE, wherein the method (100) further comprises, initializing (101) the mixing matrix using a mixing matrix determined for a frame of a clip directly preceding the current clip; and initializing (101) the power matrix based on the auto-covariance matrix of the I audio channels (302) for frame n of the current clip and based on the Wiener filter matrix determined for a frame of the clip directly preceding the current clip.

EEE 21. A storage medium comprising a software program adapted for execution on a processor and for performing the method steps of any of the previous claims when carried out on a computing device.

EEE 22. A system for extracting J audio sources (301) from I audio channels (302), with I, J>1, wherein the audio channels (302) comprise a plurality of clips, each clip comprising N frames, with N>1, wherein the I audio channels (302) are representable as a channel matrix in a frequency domain, wherein the J audio sources (301) are representable as a source matrix in the frequency domain, wherein the system is configured, for a frame n of a current clip, for at least one frequency bin f, and for a current iteration, to update a Wiener filter matrix based on a mixing matrix, which is configured to provide an estimate of the channel matrix from the source matrix, and a power matrix of the J audio sources (301), which is indicative of a spectral power of the J audio sources (301);

wherein the Wiener filter matrix is configured to provide an estimate of the source matrix from the channel matrix;

update a cross-covariance matrix of the I audio channels (302) and of the J audio sources (301) and an auto-covariance matrix of the J audio sources (301), based on the updated Wiener filter matrix; and an auto-covariance matrix of the I audio channels (302); and update the mixing matrix and the power matrix based on the updated cross-covariance matrix of the I audio channels (302) and of the J audio sources (301), and/or the updated auto-covariance matrix of the J audio sources (301).

The invention claimed is:

1. A method of extracting audio sources from audio channels, comprising, for a particular frame of a clip of a plurality of frames that has been designated as a current clip, for at least one frequency bin of a plurality of frequency bins, and for a current iteration:

(a) updating a Wiener filter matrix based on:

a mixing matrix that is configured to provide an estimate of a channel matrix from a source matrix, and a power matrix of the audio sources, the power matrix being indicative of a spectral power of the audio sources, wherein:

the audio channels comprise a plurality of clips, each clip comprising a plurality of frames, the audio channels are representable as the channel matrix in a frequency domain, the audio sources are representable as the source matrix in the frequency domain, the frequency domain is subdivided into the plurality of frequency bins, the frequency bins being grouped into a plurality of frequency bands, the Wiener filter matrix is configured to provide an estimate of the source matrix from the channel matrix, and the Wiener filter matrix is determined for each of the frequency bins;

(b) updating a cross-covariance matrix of the audio channels and the audio sources and an auto-covariance matrix of the audio sources based on:

the updated Wiener filter matrix, and an auto-covariance matrix of the audio channels; and (c) updating the mixing matrix and the power matrix based on at least one of:

the updated cross-covariance matrix of the audio channels and of the audio sources, or the updated auto-covariance matrix of the audio sources, wherein the power matrix of the audio sources is determined for the frequency bands.

2. The method of claim 1, comprising determining the auto-covariance matrix of the audio channels for the particular frame of a current clip from frames of one or more previous clips and from frames of one or more future clips.

3. The method of claim 1, comprising determining the channel matrix by transforming the audio channels from a time domain to the frequency domain, wherein the channel matrix is determined using a short-term Fourier transform.

4. The method of claim 1, comprising determining an estimate of the source matrix for the particular frame n of the current clip and for at least one frequency bin f as $S_{fn}=\Omega_{fn}X_{fn}$, wherein:

$S_{fn}$ is an estimate of the source matrix;

$\Omega_{fn}$ is the Wiener filter matrix; and $X_{fn}$ is the channel matrix.

5. The method of claim 1, wherein the updating operations determine the Wiener filter matrix, until a maximum number of iterations has been reached or until a convergence criteria with respect to the mixing matrix has been met.

6. The method of claim 1, wherein the auto-covariance matrix of the audio channels is determined for the frequency bands only.

7. The method of claim 1, wherein updating the Wiener filter matrix is further based on a noise power matrix comprising noise power terms, the noise power terms decreasing with an increasing number of iterations.

8. The method of claim 1, wherein updating the Wiener filter matrix comprises applying an orthogonal constraint with regards to the audio sources.

9. The method of claim 8, wherein the Wiener filter matrix is updated iteratively to reduce the power of non-diagonal terms of the auto-covariance matrix of the audio sources.

10. The method of claim 1, further comprising:

initializing the mixing matrix using a mixing matrix determined for a frame of a clip directly preceding the current clip; and initializing the power matrix based on the auto-covariance matrix of the audio channels for the particular frame of the current clip and based on the Wiener filter matrix determined for a frame of the clip directly preceding the current clip.

11. A system comprising:

one or more processors; and a non-transitory computer-readable medium storing instructions that, when executed by the one or more processors, cause the one or more processors to perform operations of extracting J audio sources from I audio channels, with I,J>1, wherein the audio channels comprise a plurality of clips, each clip comprising N frames, with N>1, wherein the I audio channels are representable as a channel matrix in a frequency domain, wherein the J audio sources are representable as a source matrix in the frequency domain, wherein the frequency domain is subdivided into F frequency bins, wherein the F frequency bins are grouped into $\bar{F}$ frequency bands, with $\bar{F}<F$; wherein the operations comprise, for a frame n of a current clip, for at least one frequency bin f , and for a current iteration:

updating a Wiener filter matrix based on a mixing matrix, which is configured to provide an estimate of the channel matrix from the source matrix, and a power matrix of the J audio sources, which is indicative of a spectral power of the J audio sources;

wherein the Wiener filter matrix is configured to provide an estimate of the source matrix from the channel matrix; wherein the Wiener filter matrix is determined for each of the F frequency bins;

updating a cross-covariance matrix of the I audio channels and of the J audio sources and an auto-covariance matrix of the J audio sources, based on the updated Wiener filter matrix; and an auto-covariance matrix of the I audio channels; and updating the mixing matrix and the power matrix based on at least one of:

the updated cross-covariance matrix of the I audio channels and of the J audio sources, or the updated auto-covariance matrix of the J audio sources; wherein the power matrix of the J audio sources is determined for the $\bar{F}$ frequency bands only.

12. A non-transitory computer-readable medium storing instructions that, when executed by the one or more processors, cause the one or more processors to perform operations comprising, for a particular frame of a clip of a plurality of frames that has been designated as a current clip, for at least one frequency bin of a plurality of frequency bins, and for a current iteration, (a) updating a Wiener filter matrix based on:

a mixing matrix that is configured to provide an estimate of a channel matrix from a source matrix, and a power matrix of the audio sources, the power matrix being indicative of a spectral power of the audio sources, wherein:

the audio channels comprise a plurality of clips, each clip comprising a plurality of frames, the audio channels are representable as the channel matrix in a frequency domain, the audio sources are representable as the source matrix in the frequency domain, the frequency domain is subdivided into the plurality of frequency bins, the frequency bins being grouped into a plurality of frequency bands, the Wiener filter matrix is configured to provide an estimate of the source matrix from the channel matrix, and the Wiener filter matrix is determined for each of the frequency bins;

(b) updating a cross-covariance matrix of the audio channels and the audio sources and an auto-covariance matrix of the audio sources based on:

the updated Wiener filter matrix, and an auto-covariance matrix of the audio channels; and (c) updating the mixing matrix and the power matrix based on at least one of:

the updated cross-covariance matrix of the audio channels and of the audio sources, or the updated auto-covariance matrix of the audio sources, wherein the power matrix of the audio sources is determined for the frequency bands.

* * * * *